US005966097A

United States Patent [19]

Fukasawa et al.

[11] Patent Number: 5,966,097

[45] Date of Patent: Oct. 12, 1999

[54] ANTENNA APPARATUS

[75] Inventors: Toru Fukasawa; Isamu Chiba; Tsutomu Endo; Shin-ichi Satoh; Shuji Urasaki, all of Tokyo, Japan

[73] Assignee: Mitsubishi Denki Kabushiki Kaisha, Tokyo, Japan

[21] Appl. No.: 08/856,190

[22] Filed: May 14, 1997

[30] Foreign Application Priority Data

Jun. 3, 1996 [JP] Japan ..... 8-140191

[51] Int. Cl.[6] ..... H01Q 1/38

[52] U.S. Cl. ..... 343/700 MS; 343/702; 343/895; 343/846

[58] Field of Search ..... 343/700 MS, 702, 343/895, 846

[56] References Cited

U.S. PATENT DOCUMENTS

| | | | |
|---|---|---|---|
| 4,584,585 | 4/1986 | Marko et al. . | |
| 4,907,006 | 3/1990 | Nishikawa et al. | 343/700 MS |
| 5,585,807 | 12/1996 | Takei | 343/700 MS |

FOREIGN PATENT DOCUMENTS

| | | |
|---|---|---|
| 0 691 738 A1 | 1/1986 | European Pat. Off. . |
| 0 332 139 A2 | 9/1989 | European Pat. Off. . |
| 56-012102 | 2/1981 | Japan . |
| 5-347507 | 12/1993 | Japan . |
| 6-069715 | 3/1994 | Japan . |
| 6-69715 | 3/1994 | Japan . |
| 7-131234 | 5/1995 | Japan . |
| WO 84/04427 | 11/1984 | WIPO . |
| WO 91/02386 | 2/1991 | WIPO . |

*Primary Examiner*—Don Wong
*Assistant Examiner*—Hoang Nguyen

[57] ABSTRACT

A non-driven first linear element is disposed in the vicinity of an inverted-F second linear antenna element. The driven second linear element is disposed over a conductive plate having a flat shape, in such a manner as to be substantially parallel to the inverted-F antenna. The non-driven element has a short-circuited end of the inverted-F antenna, and has substantially the same resonant frequency as that of the inverted-F antenna.

12 Claims, 6 Drawing Sheets

ANTENNA APPARATUS

BACKGROUND OF THE INVENTION

1. Field of the Invention

The present invention relates to a double resonant antenna apparatus suitable for use as an built-in antenna of a portable radio unit.

2. Description of the Related Art

As conventional double resonant antenna apparatuses, those disclosed in, for example, Japanese Patent Application Laid-Open Nos. 347507/1993 and 69715/1994 are known. FIG. 12 is a schematic diagram of the antenna apparatus shown in Japanese Patent Application Laid-Open No. 347507/1993. In the drawing, reference numeral 14 denotes a flexible printed wiring board; 15, a feeding element; and 16, a nonfeeding element. FIG. 13 is a schematic diagram of the antenna apparatus shown in Japanese Patent Application Laid-Open No. 69715/1994. In the drawing, reference numeral 17 denotes an inverted-F antenna, and 18 an induction dielectric element.

The double resonant antenna described in Japanese Patent Application Laid-Open No. 347507/1993 has a drawback in that the apparatus assumes a high attitude since it is assumed that the antenna is installed perpendicular to a conductive plate. On the other hand, the double resonant antenna described in Japanese Patent Application Laid-Open No. 69715/1994 has a drawback in that since the inverted-F antenna and a short-circuited end of the inductance dielectric element are on the same side with respect to the antenna, coupling between the two elements is weak.

SUMMARY OF THE INVENTION

The present invention has been devised to eliminate the above-described drawbacks of the conventional art, and therefore a first object of the present invention is to obtain impedance characteristics a double resonance.

A second object of the present invention is to lower the attitude of the antenna apparatus. Its third object is to shorten the physical length of the antenna.

In order to achieve the above objects, the antenna apparatus in accordance with one aspect of the present invention comprises a conductive plate having the shape of a flat plate; a first linear conductor disposed over the conductive plate substantially in parallel therewith, having an electrical length of an about ¼ wavelength of a frequency used, and having one end short-circuited with the conductive plate and another end open; and a second linear conductor which is disposed over the conductive plate in such a manner as to be substantially parallel to the first linear conductor and substantially parallel to the conductive plate, has an electrical length of an about ¼ wavelength of the frequency used, and has one end, located on a side away from the short-circuited end of the first linear conductor, short-circuited with the conductive plate and another end open, wherein feeding is effected between the conductive plate and a point between the short-circuited end and the open end of one of the two linear conductors.

In addition, the antenna apparatus in accordance with another aspect of the present invention comprises a conductive plate having the shape of a flat plate; a first linear conductor disposed over the conductive plate substantially in parallel therewith and having an electrical length of an about ½ wavelength of a frequency used; and a second linear conductor which is disposed over the conductive plate in such a manner as to be substantially parallel to the first linear conductor and substantially parallel to the conductive plate, has an electrical length of an about ¼ wavelength of the frequency used, and has one end short-circuited with the conductive plate and another end open, wherein feeding is effected between the conductive plate and a point between the short-circuited end and the open end of the second linear conductor having the electrical length of an about ¼ wavelength.

Further, at least one of the linear conductors is bent in a meandering shape.

Further, the open end of at least one of the first and second linear conductors is short-circuited with the conductive plate via a capacitor.

Further, a portion of at least one of the first and second linear conductors is bent toward the conductive plate to partially reduce a gap between the conductive plate and the individual linear conductor.

Further, an electrically conductive block is disposed in a gap between the conductive plate and at least one of the linear conductors.

Further, a dielectric block is disposed in a gap between the conductive plate and at least one of the linear conductors.

The above and other objects and features of the present invention will be more apparent from the following description taken in conjunction with the accompanying drawings.

DETAILED DESCRIPTION OF THE PREFERRED EMBODIMENTS (First Embodiment)

Figure 1:
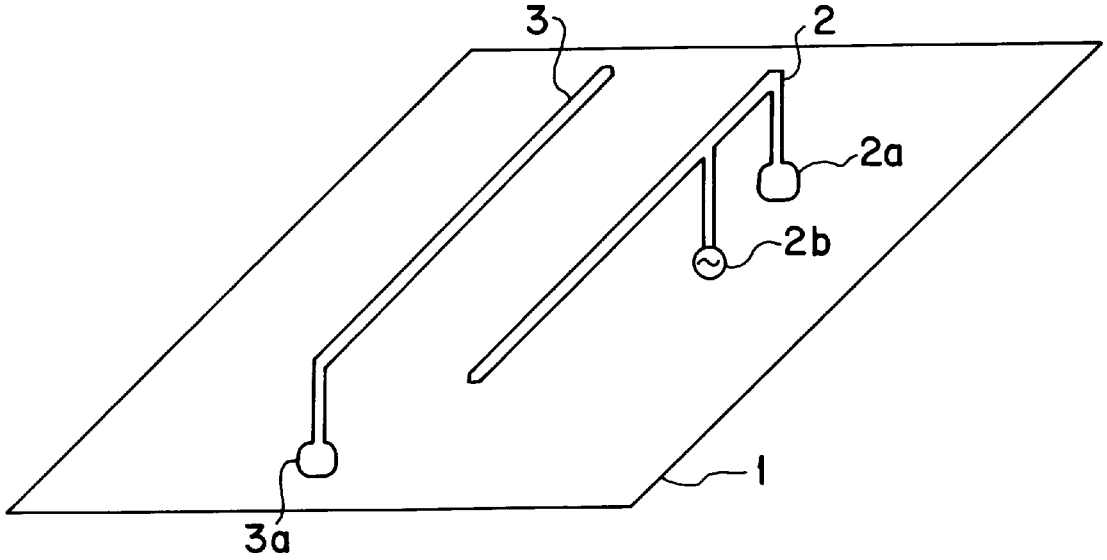
FIG. 1 is schematic diagram of an antenna apparatus illustrating a first embodiment of the present invention

FIG. 1 is a schematic diagram illustrating a first embodiment of the present invention. In the drawing, reference numeral 1 denotes a conductive plate having the shape of a flat plate; 2, a linear inverted-F antenna constituted by a linear conductor which is disposed over the conductive plate 1 substantially in parallel therewith, has an electrical length of an about ¼ wavelength of the frequency used, and has one end short-circuited with the conductive plate 1 and another end open; and 3, a nondriven element constituted by a linear conductor which is disposed over the conductive plate 1 in such a manner as to be substantially parallel to the inverted-F antenna 2 and substantially parallel to the conductive plate 1, has an electrical length of an about ¼ wavelength of the frequency used, and has one end, located on the side away from the short-circuited end of the inverted-F antenna 2, short-circuited with the conductive plate 1 and another end open. Incidentally, reference numeral 2*a* denotes the short-circuited end of the inverted-F antenna 2, and 2*b* denotes a feeding point of the inverted-F antenna 2 which is adapted to effect feeding between the conductive plate 1 and a point between the short-circuited end 2*a* and the open end. Numeral 3*a* denotes a short-circuited end of the nondriven element 3.

Figure 2A:
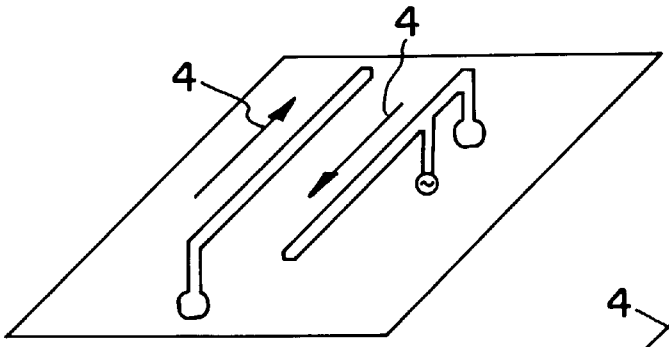
FIG. 2A is a schematic diagram of an even mode occurring in the antenna apparatus in accordance with the first embodiment of the present invention.
Figure 2B:
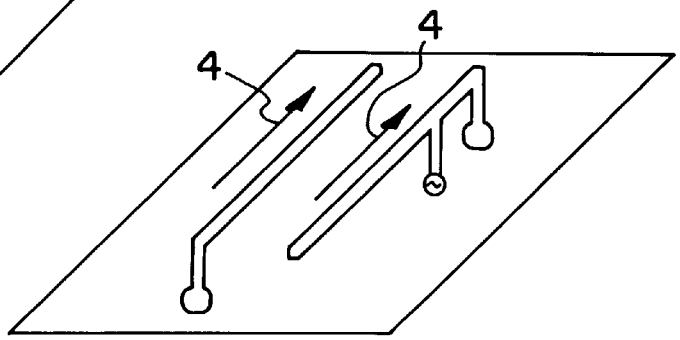
FIG. 2B is a schematic diagram of an odd mode occurring in the antenna apparatus in accordance with the first embodiment of the present invention.

Next, a description will be given of the operating principle of the first embodiment. In the arrangement provided, the nondriven element 3, whose end located on the side away from the short-circuited end 2*a* of the inverted-F antenna 2 is short-circuited at 3*a* and has substantially the same resonant frequency as that of the inverted-F antenna 2. This non-driven element 3 is disposed in the vicinity of the inverted-F antenna 2 in such a manner as to be substantially parallel therewith, an odd mode and an even mode occur as shown in FIGS. 2A and 2B, and resonance occurs at two different frequencies according to these modes. Incidentally, in FIGS. 2A and 2B, reference numeral 4 indicates the direction of electric current.

Figure 3:
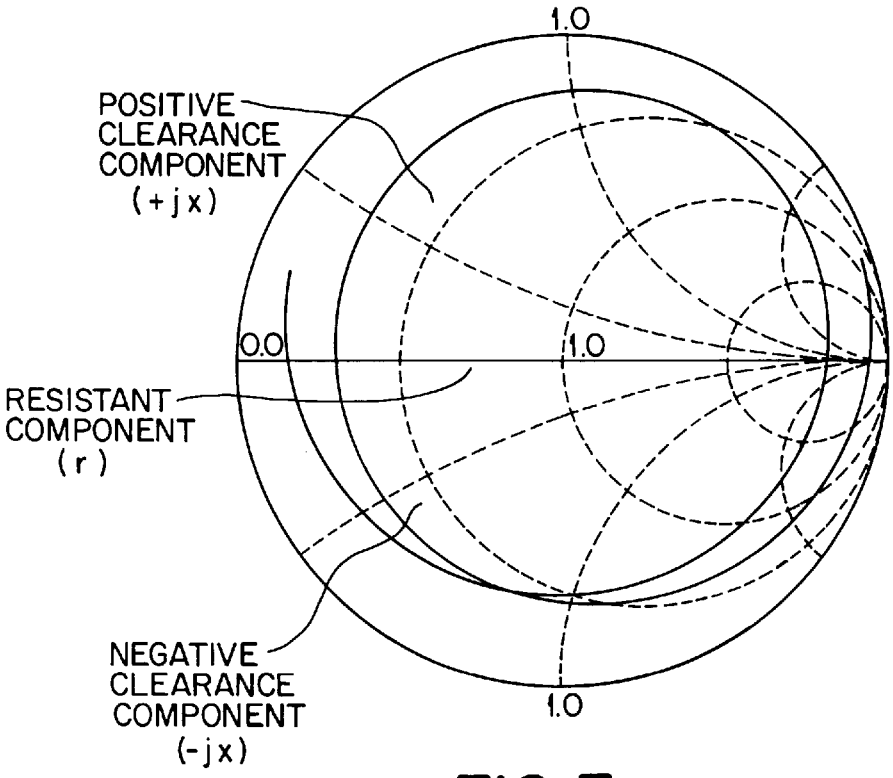
FIG. 3 is a diagram illustrating impedance characteristics of the antenna apparatus in accordance with the first embodiment of the present invention.
Figure 4:
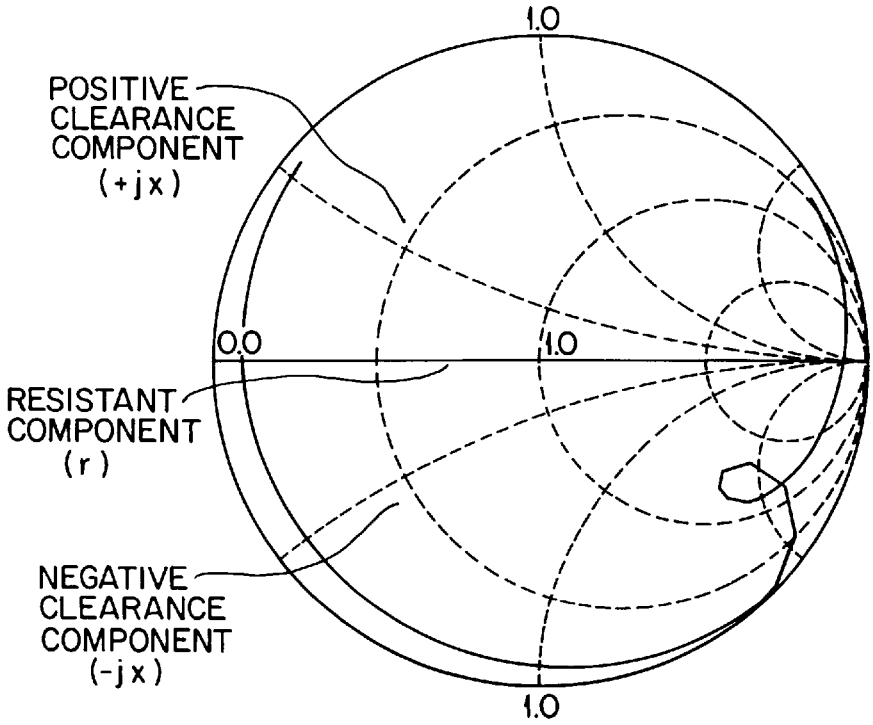
FIG. 4 is a diagram illustrating, by way of reference, impedance characteristics of an antenna apparatus in which an inverted-F antenna and a nondriven element whose end located on the same side as the short-circuited end of the inverted-F antenna is short-circuited are arrayed.

FIG. 3 shows impedance characteristics of the antenna apparatus in accordance with the first embodiment. FIG. 4 shows impedance characteristics of an antenna apparatus in which a nondriven element whose end located on the same side as the short-circuited end of the inverted-F antenna is short-circuited is disposed in the vicinity of the inverted-F antenna which is a driven element. In accordance with the first embodiment shown in FIG. 3, coupling between the inverted-F antenna and the nondriven element is strong as compared to the antenna apparatus shown in FIG. 4, and the characteristics of double resonance appears appreciably.

(Second Embodiment)

Figure 5:
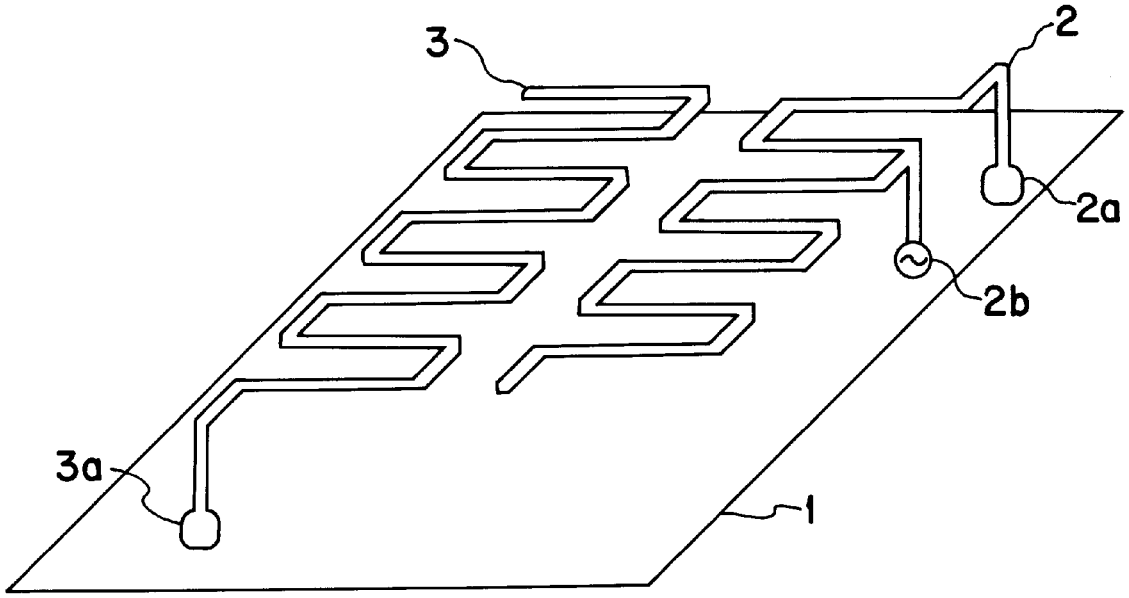
FIG. 5 is a schematic diagram of the antenna apparatus illustrating a second embodiment of the present invention.

FIG. 5 is a schematic diagram illustrating a second embodiment of the present invention. Since the component parts which are identical or correspond to those of the first embodiment are denoted by the same reference numerals, a description will be given of only the point which differs from the first embodiment. Reference numeral 2 denotes an inverted-F antenna formed by bending a linear conductor into a meandering shape, and 3 denotes a nondriven element which is similarly formed by bending a linear conductor into a meandering shape and has an electrical length of a ¼ wavelength.

The operating principle of this second embodiment is similar to that of the first embodiment, but as the linear conductors are bent in the meandering shapes, the physical length of the antenna can be shortened.

(Third Embodiment)

Figure 6:
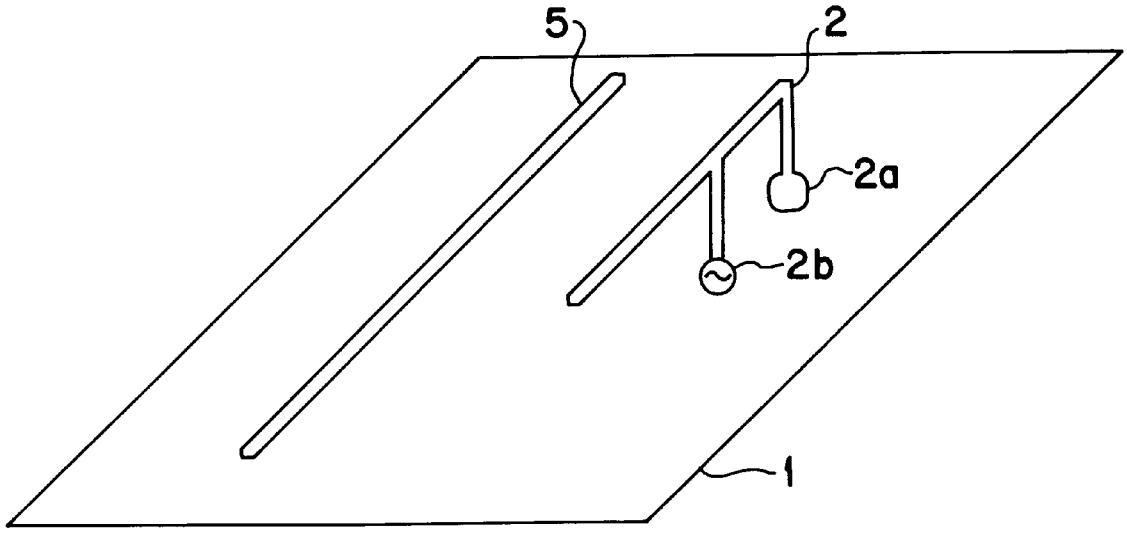
FIG. 6 is a schematic diagram of the antenna apparatus illustrating a third embodiment of the present invention.

FIG. 6 is a schematic diagram illustrating a third embodiment of the present invention. Since the component parts which are identical or correspond to those of the first embodiment are denoted by the same reference numerals, a description will be given of only the point which differs from the first embodiment. Reference numeral 5 denotes a nondriven element which is constituted by a linear conductor having an electrical length of a ½ wavelength, and this nondriven element 5 is not provided with a portion which is perpendicular to the plane of the conductive plate 1.

Next, a description will be given of the operating principle of the third embodiment. In the first embodiment, during the resonance in the even mode, the phases of the electric current which flows across the portions of the inverted-F antenna 2 and the nondriven element 3 which are perpendicular to the plane of the conductive plate 1 become opposite, and offset the radiation each other, so that the band becomes a narrow band during the even-mode resonance. To overcome this situation, the nondriven element 3 having the electrical length of a ¼ wavelength is replaced by the nondriven element 5 having the electrical length of a ½ wavelength, so as to eliminate the electric current flowing across the portion of the nondriven element which is perpendicular to the plane of the conductive plate 1, thereby making it possible to obtain a wide band even during the even-mode resonance.

(Fourth Embodiment)

Figure 7:
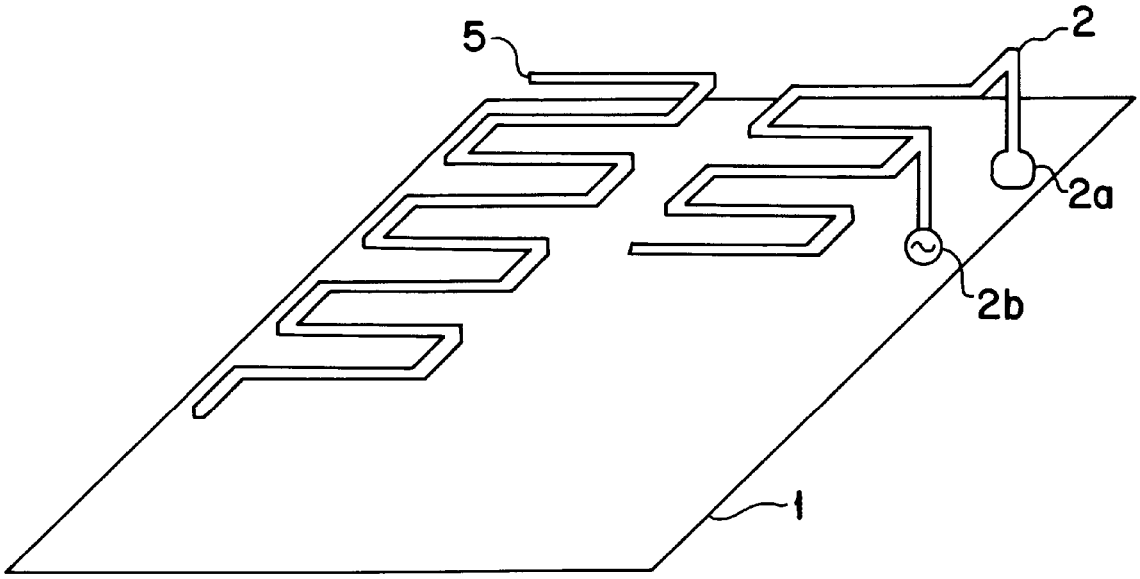
FIG. 7 is a schematic diagram of the antenna apparatus illustrating a fourth embodiment of the present invention.

FIG. 7 is a schematic diagram illustrating a fourth embodiment of the present invention. Since the component parts which are identical or correspond to those of the first embodiment are denoted by the same reference numerals, a description will be given of only those aspects which differ from the first embodiment. Reference numeral 2 denotes the inverted-F antenna formed by bending a linear conductor into a meandering shape, and numeral 5 denotes a nondriven element formed by bending a linear conductor having an electrical length of a ½ wavelength into a meandering shape, and this nondriven element 5 is not provided with a portion which is perpendicular to the plane of the conductive plate 1.

The operating principle of this fourth embodiment is similar to that of the third embodiment (Fifth Embodiment)

Figure 8:
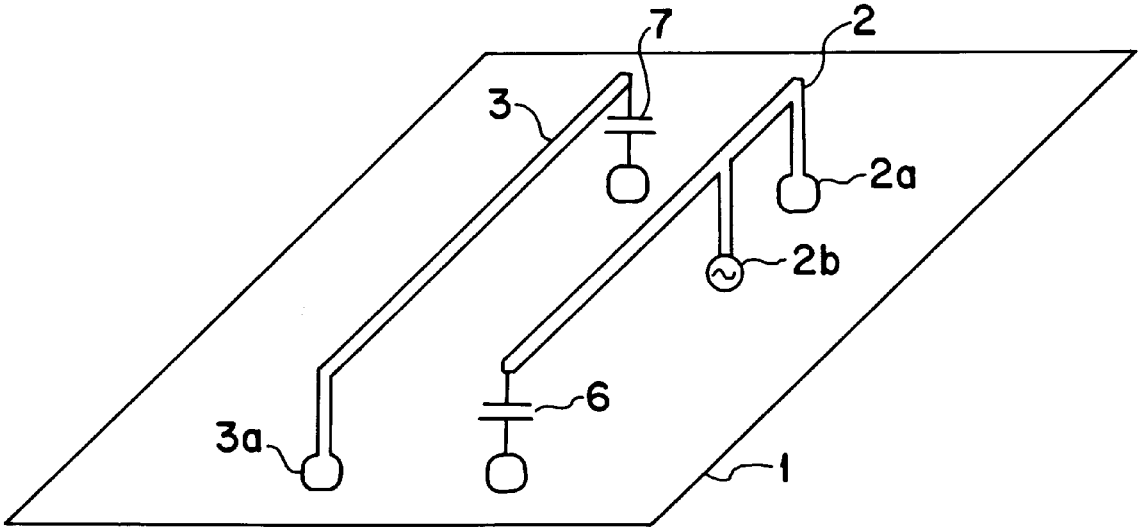
FIG. 8 is a schematic diagram of the antenna apparatus illustrating a fifth embodiment of the present invention.

FIG. 8 is a schematic diagram illustrating a fifth embodiment of the present invention. Since the component parts which are identical or correspond to those of the first embodiment are denoted by the same reference numerals, a description will be given of only those aspects which differ from the first embodiment. Reference numerals 6 and 7 denote capacitors for short-circuiting the open ends of the inverted-F antenna 2 and the nondriven element 3, respectively, with the conductive plate 1.

Next, a description will be given of the operating principle of the fifth embodiment. The inverted-F antenna 2 and the nondriven element 3 can be regarded as constituting a resonator comprising two parallel lines whose one ends are short-circuited and other ends are open. By providing the open ends of the resonator with capacitances comprising the capacitors 6 and 7, it is possible to lower the resonant frequency. That is, it is possible to shorten the physical length of the resonator to obtain the same resonant frequency.

(Sixth Embodiment)

Figure 9:
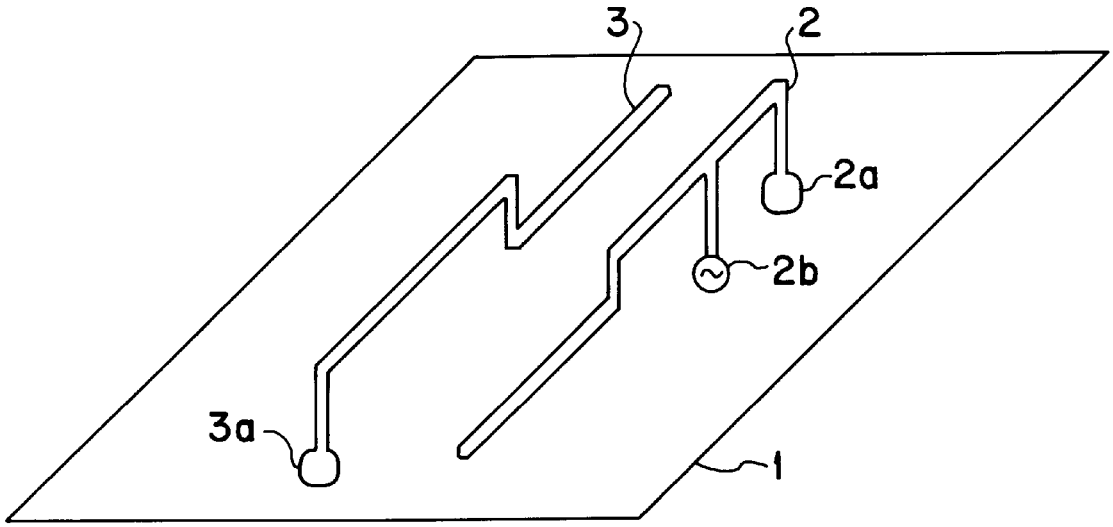
FIG. 9 is a schematic diagram of the antenna apparatus illustrating a sixth embodiment of the present invention.

FIG. 9 is a schematic diagram illustrating a sixth embodiment of the present invention. Since the component parts which are identical or correspond to those of the first embodiment are denoted by the same reference numerals, a description will be given of only those aspects which differ from the first embodiment. Reference numeral 2 denotes a linear inverted-F antenna formed by bending a substantially central portion of a linear conductor toward the conductive plate 1 into a cranked shape so as to partially reduce the gap between the conductive plate 1 and the linear conductor. Numeral 3 denotes a nondriven element which is similarly formed by bending a substantially central portion of a linear conductor toward the conductive plate 1 into a cranked shape so as to partially reduce the gap between the conductive plate 1 and the linear conductor, and has an electrical length of a ¼ wavelength.

Next, a description will be given of the operating principle of the sixth embodiment. Since the substantially central portions of the inverted-F antenna 2 and the nondriven element 3 constituted by linear conductors are bent toward the conductive plate 1 into the cranked shapes so as to partially reduce the gap between the conductive plate 1 and the respective linear conductor, capacitances occur at the bent portions. Hence, it is possible to shorten the length of the antenna.

(Seventh Embodiment)

Figure 10:
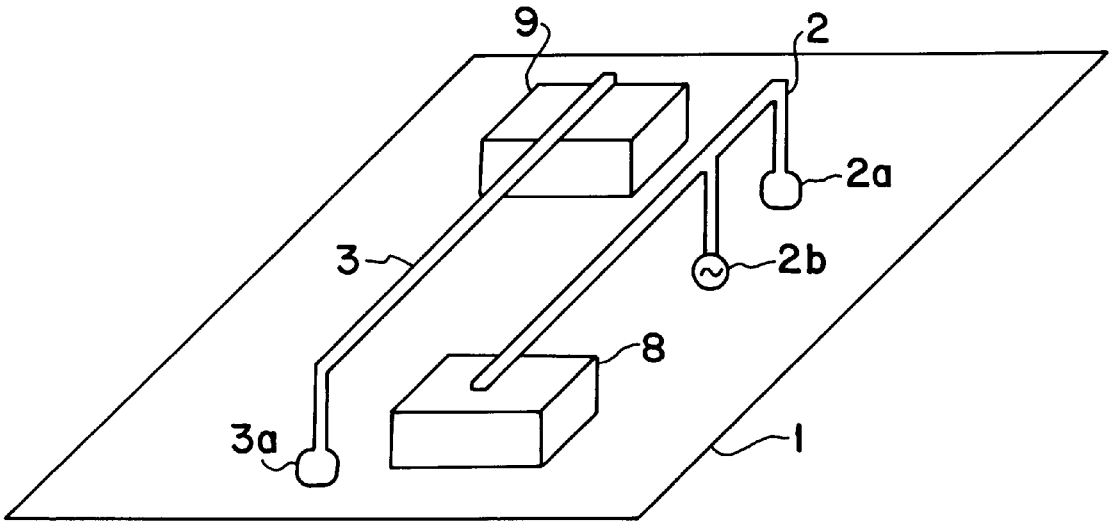
FIG. 10 is a schematic diagram of the antenna apparatus illustrating a seventh embodiment of the present invention.

FIG. 10 is a schematic diagram illustrating a seventh embodiment of the present invention. Since the component parts which are identical or correspond to those of the first embodiment are denoted by the same reference numerals, a description will be given of only those aspects which differ from the first embodiment. Reference numerals 8 and 9 denote conductive blocks which are respectively provided in the gaps between the conductive plate 1 on the one hand, and the inverted-F antenna 2 and the nondriven element 3 on the other.

Next, a description will be given of the operating principle of the seventh embodiment. Since the conductive blocks 8 and 9 are provided in the gaps between the conductive plate 1 on the one hand, and the inverted-F antenna 2 and the nondriven element 3 on the other, capacitances occur at those portions. Hence, it is possible to shorten the length of the antenna.

(Eighth Embodiment)

Figure 11:
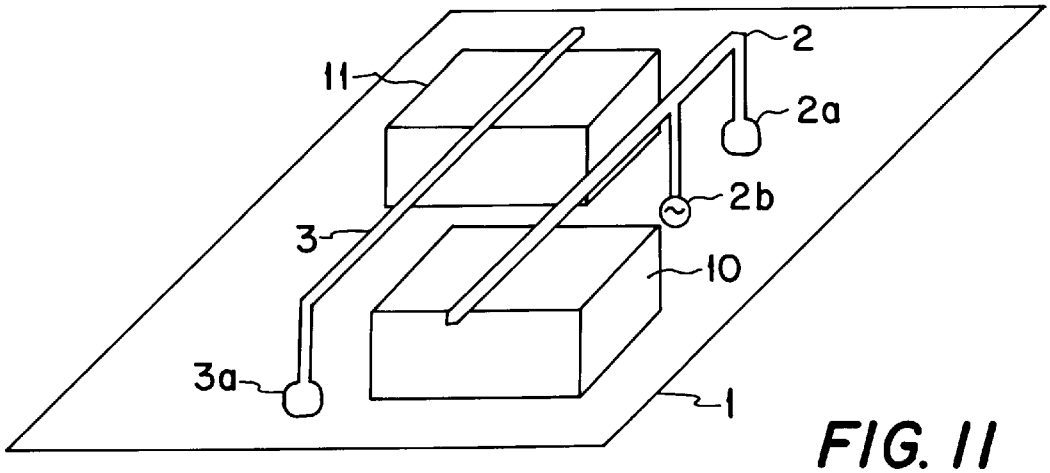
FIG. 11 is a schematic diagram of the antenna apparatus illustrating an eighth embodiment of the present invention.
Figure 12:
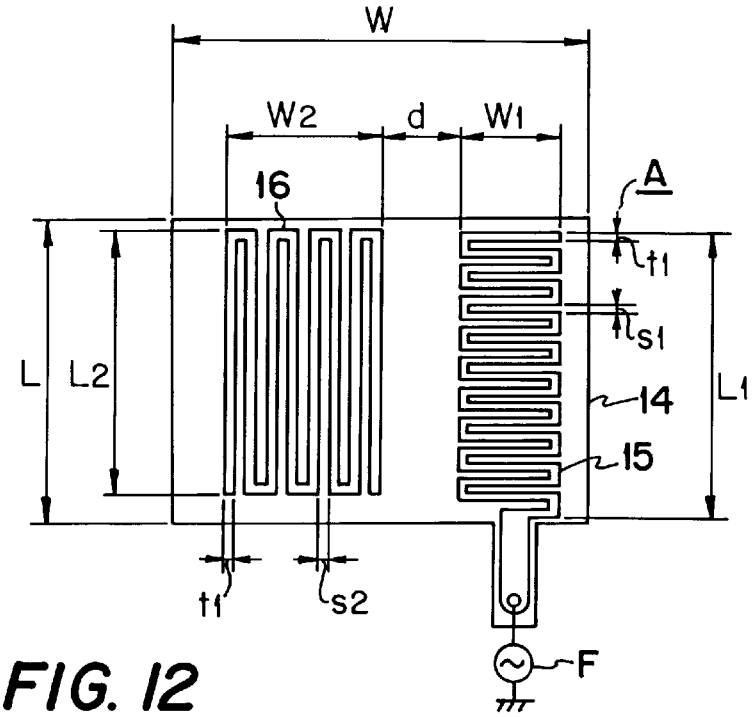
FIG. 12 (PRIOR ART)
FIG. 12 is a schematic diagram illustrating a conventional double resonant antenna apparatus.
Figure 13:
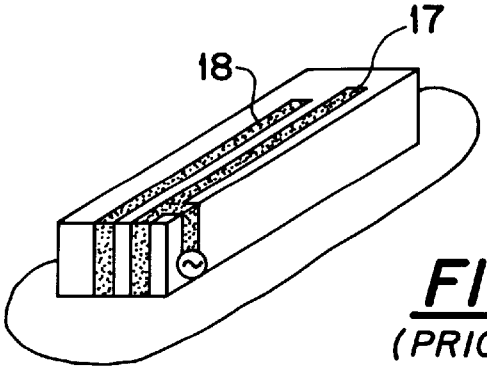
FIG. 13 (PRIOR ART)
FIG. 13 is a schematic diagram illustrating a different conventional double resonant antenna apparatus.

FIG. 11 is a schematic diagram illustrating an eighth embodiment of the present invention. Since the component parts which are identical or correspond to those of the first embodiment are denoted by the same reference numerals, a description will be given of only those aspects which differ from the first embodiment. Reference numerals 10 and 11 denote dielectric blocks which are respectively provided in the gaps between the conductive plate 1 on the one hand, and the inverted-F antenna 2 and the nondriven element 3 on the other.

Next, a description will be given of the operating principle of the eighth embodiment. Since the dielectric blocks 10 and 11 are provided in the gaps between the conductive plate 1 on the one hand, and the inverted-F antenna 2 and the nondriven element 3 on the other, a wavelength-reducing effect is produced, so that it is possible to make the antenna apparatus compact.

Since the double resonant antenna apparatus in accordance with the present invention is configured as described above, the following advantages can be offered.

The arrangement provided is such that the antenna apparatus comprises: a conductive plate having the shape of a flat plate; a first linear conductor disposed over the conductive plate substantially in parallel therewith, having an electrical length of an about ¼ wavelength of a frequency used, and having one end short-circuited with the conductive plate and another end open; and a second linear conductor which is disposed over the conductive plate in such a manner as to be substantially parallel to the first linear conductor and substantially parallel to the conductive plate, has an electrical length of an about ¼ wavelength of the frequency used, and has one end, located on a side away from the short-circuited end of the first linear conductor, short-circuited with the conductive plate and another end open, wherein feeding is effected between the conductive plate and a point between the short-circuited end and the open end of one of these two linear conductors. Accordingly, it becomes possible to obtain impedance characteristics of double resonance, and lower the attitude of the antenna apparatus.

Further, since at least one of the linear conductors is bent in a meandering shape it becomes possible to obtain impedance characteristics of double resonance, lower the attitude of the antenna apparatus, and shorten the length of the antenna.

Another arrangement provided is such that the antenna apparatus comprises: a conductive plate having the shape of a flat plate; a first linear conductor disposed over the conductive plate substantially in parallel therewith and having an electrical length of an about ½ wavelength of a frequency used; and a second linear conductor which is disposed over the conductive plate in such a manner as to be substantially parallel to the first linear conductor and substantially parallel to the conductive plate, has an electrical length of an about ¼ wavelength of the frequency used, and has one end short-circuited with the conductive plate and another end open, wherein feeding is effected between the conductive plate and a point between the short-circuited end and the open end of the second linear conductor having the electrical length of an about ¼ wavelength. Accordingly, it becomes possible to obtain impedance characteristics of double resonance, and lower the attitude of the antenna apparatus.

Further, since the open end of at least one of the linear conductors is short-circuited with the conductive plate via a capacitor, it becomes readily possible to obtain impedance characteristics of double resonance, lower the attitude of the antenna apparatus, and shorten the length of the antenna.

Since a portion of at least one of the linear conductors is bent toward the conductive plate to partially reduce a gap between the conductive plate and the linear conductor, it becomes more readily possible to obtain impedance characteristics of double resonance, lower the attitude of the antenna apparatus, and shorten the length of the antenna.

Since an electrically conductive block is disposed in a gap between the conductive plate and at least one of the linear conductors, it becomes readily possible to obtain impedance characteristics of double resonance, lower the attitude of the antenna apparatus, and shorten the length of the antenna.

Since a dielectric block is disposed in a gap between the conductive plate and at least one of the linear conductors, it becomes more readily possible to obtain impedance characteristics of double resonance, lower the attitude of the antenna apparatus, and shorten the length of the antenna.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An antenna apparatus comprising:

a conductive plate having the shape of a flat plate;

a first linear conductor disposed over said conductive plate substantially in parallel therewith, having an electrical length of an about ¼ wavelength of a frequency used, and having one end short-circuited with said conductive plate and another end open; and a second linear conductor which is disposed over said conductive plate so as to be substantially parallel to but not coaxial with said first linear conductor and substantially parallel to said conductive plate, has an electrical length of an about ¼ wavelength of the frequency used, and has one end, located on a side away from the short-circuited end of said first linear conductor, short-circuited with said conductive plate and another end open, wherein feeding is effected between said conductive plate and a point between the short-circuited end and the open end of said second linear conductors.

2. An antenna apparatus according to claim 1, wherein at least one of said linear conductors is bent in a meandering shape.

3. An antenna apparatus according to claim 1, wherein the open end of at least one of said linear conductors is electrically connected with said conductive plate via a capacitor.

4. An antenna apparatus according to claim 1, wherein a portion of at least one of said linear conductors is bent toward said conductive plate to partially reduce a gap between said conductive plate and said linear conductor.

5. An antenna apparatus according to claim 1, wherein an electrically conductive block is disposed in a gap between said conductive plate and at least one of said linear conductors.

6. An antenna apparatus according to claim 1, wherein a dielectric block is disposed in a gap between said conductive plate and at least one of said linear conductors.

7. An antenna apparatus comprising:

a conductive plate having the shape of a flat plate;

a first linear conductor disposed over said conductive plate substantially in parallel therewith and having an electrical length of an about ½ wavelength of a frequency used; and a second linear conductor which is disposed over said conductive plate in such a manner as to be substantially parallel to but not coaxial with said first linear conductor and substantially parallel to said conductive plate, has an electrical length of an about ¼ wavelength of the frequency used, and has one end short-circuited with said conductive plate and another end open, wherein feeding is effected between said conductive plate and a point between the short-circuited end and the open end of said second linear conductor having the electrical length of an about ¼ wavelength.

8. An antenna apparatus according to claim 7, wherein at least one of said linear conductors is bent in a meandering shape.

9. An antenna apparatus according to claim 7, wherein the open end of at least one of said linear conductors is electrically coupled with said conductive plate via a capacitor.

10. An antenna apparatus according to claim 7, wherein a portion of at least one of said linear conductors is bent toward said conductive plate to partially reduce a gap between said conductive plate and said linear conductor.

11. An antenna apparatus according to claim 7, wherein an electrically conductive block is disposed in a gap between said conductive plate and at least one of said linear conductors.

12. An antenna apparatus according to claim 7, wherein a dielectric block is disposed in a gap between said conductive plate and at least one of said linear conductors.

* * * * *